United States Patent [19]

Bretegnier et al.

[11] 4,328,662

[45] May 11, 1982

[54] MULTIPLY TWISTING MACHINE FOR HIGH SPEED HELICAL WINDING OF UNITARY STRANDS TO FORM A CABLE

[75] Inventors: Pierre Bretegnier, Anet; René Fortassy, Ivry-la-Bataille, both of France

[73] Assignee: Eurocable, S.A., France

[21] Appl. No.: 61,405

[22] Filed: Jul. 27, 1979

[30] Foreign Application Priority Data

Jul. 28, 1978 [FR] France ..... 78 22436

[51] Int. Cl.[3] ..... D01H 7/86; D07B 3/12

[52] U.S. Cl. ..... 57/58.61; 57/58.52; 57/58.65

[58] Field of Search ..... 57/58.52–58.57, 57/58.61, 58.63, 58.65–58.7, 58.83

[56] References Cited

U.S. PATENT DOCUMENTS

| | | | |
|---|---|---|---|
| 1,690,373 | 11/1928 | Marchev | 57/58.61 X |
| 2,252,465 | 8/1941 | Kraft | 57/58.65 |
| 2,526,147 | 10/1950 | MacCreadie | 57/58.61 X |
| 3,147,581 | 9/1964 | Godderidge | 57/58.63 |
| 3,956,875 | 5/1976 | Lenorak | 57/58.61 |
| 4,165,599 | 8/1979 | Lenorak | 57/58.83 |

FOREIGN PATENT DOCUMENTS

| | | |
|---|---|---|
| 695144 | 9/1930 | France . |
| 1231286 | 4/1960 | France . |
| 1352139 | 1/1964 | France . |
| 1405341 | 5/1965 | France . |
| 572344 | 10/1945 | United Kingdom . |
| 959896 | 6/1964 | United Kingdom . |

*Primary Examiner*—John Petrakes

*Attorney, Agent, or Firm*—Sandler & Greenblum

[57] ABSTRACT

A multiple twisting machine, particularly adapted for quadruple twisting, said machine adapted to helically twist unitary strands and form a cable. The machine comprises two coaxially rotating frames, one frame being driven by the other frame via a reverser, said reverser rendered immoble by a weight and coupled to each of said frames by a belt. One of the frames comprises an external frame driven by pulleys at its ends and comprises two side plates connected by a stretched, taut rope which guides the cable over a portion of its path. The unitary strands enter the machine and the cable follows a predetermined path which ends where the cable is twisted about a cradle pulley which is stabilized by the weight. The internal frame is light and balanced to permit an elevated speed at rotation and speed up cable production.

8 Claims, 6 Drawing Figures

Figure 1:
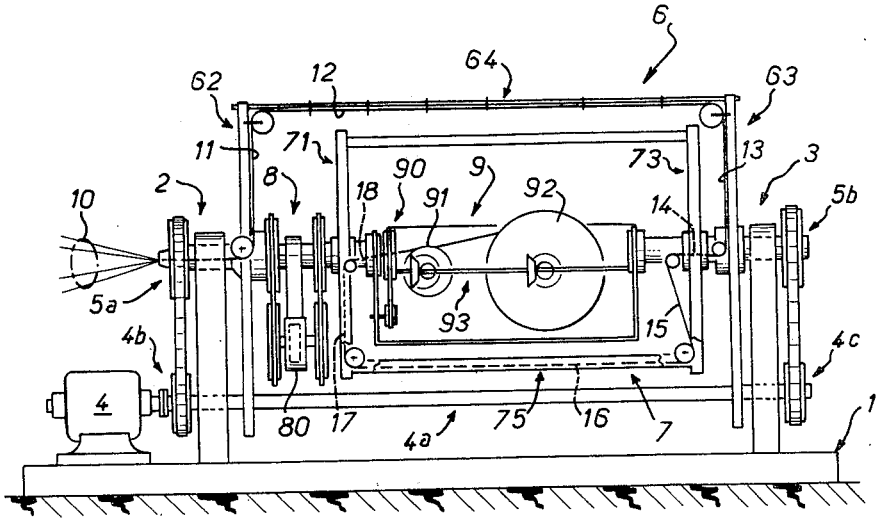

MULTIPLY TWISTING MACHINE FOR HIGH SPEED HELICAL WINDING OF UNITARY STRANDS TO FORM A CABLE

1. Background of the Invention

The invention relates to an apparatus for multiply twisting adapted to helically wind along a desired path a plurality of individual strands fed from feed bobbins and to deliver a cable to a pulling post; more particularly the invention relates to a quadruple twisting device.

To manufacture a cable, one winds together a multiplicity of individual strands into a helix along a desired path, this path being defined by the length advanced by the cable for a turn of the helix. Originally the twisting was obtained by mounting feed bobbins, on which the individual strands are wound, on a spinning wheel, while the cable was pulled by a winch or an analogous device. Each turn of the spinning wheel corresponded to a turn of the helix.

2. Discussion of Prior Art

The speed of production of a cable with a given path is limited essentially by the maximum speed of rotation which the spinning wheel can withstand, in particular due to centrifugal forces. To increase the speed of production of the cable, "double twist" devices have been devised, which comprise a means for pulling the cable to a pulling station, a frame rotatably driven around a horizontal axis, coupled to the traction means and defining between two bearings an eccentric portion of the path of the cable which describes around the axis a surface of revolution enclosing an internal space, and in this internal space a cradle mounted directly along the axis and rendered immobile by a weight, the cable length extending from one end in the cradle to an end outside of the internal space and axially passing in the two bearings where the cable receives two twists in the same direction. At one of the ends of the path of the cable is arranged a pulling station, while the feed bobbins are arranged at the other end. It should be noted that the direction of twisting of the cable is the direction of rotation of the radial driving element of the cable, seen from the side of the axial progression, independently of the direction the cable is pulled, such that the pulling station can be situated either in the cradle or to the exterior of the internal space of the frame in rotation. However, in order that the twists be in the same direction as the two bearings of the frame, it is necessary that the two ends of the cable path be arranged one on the interior and the other to the exterior of the internal space described by the rotation of the frame, and thus of the eccentric portion of the cable path.

Double twist devices make it possible to substantially double the speed of production of the cable in comparison with spinning wheel devices. In effect, being given that the centrifugal force is proportional to the square of the speed of rotation, there exists a technological limit to the permissible speed of rotation, and it is in fact exceptional for the speed of rotation of winding machines to exceed 1200 rpm. At this speed of rotation, the production speed of the cable by double twist is 100 lengths per second (or 360,000 lengths per hour). For a length of 14 mm, this corresponds to a production of 5000 meters per hour. The need has been felt to go further to speed up production. But by virtue of the technological limitation of the speed of rotation of the frames, the increase of speed of production could not be obtained except by an increase in the number of twists.

In the state of the art it is known, as evidenced by British Pat. Nos. 959,896 and 572,344, French Pat. Nos. 695,144, 1,231,286 and 1,405,341, and U.S. Pat. Nos. 1,690,373 and 2,526,147 which disclose machines comprising a traction means for the cable at the pulling station, a multiplicity of frames in coaxial rotation nested successively from a first central frame to a latter external frame driven by a motor, each frame driven in a direction opposite to that of the frame which follows it in succession with substantially the same speed by means of a reverser means and each of the frames defining between two bearings an eccentric portion of the path of the cable describing a surface of revolution enclosing an internal space and extending from one end in the internal space to another end outside of this internal space and passing via two bearings where the cable receives two twists in the same direction, in the internal space of the first frame a cradle mounted whereby the axis may be rotated without rotating the cradle which is rendered immobile by a disequilibrium and defining an end of the path of cable such the the cable comprises from one end to the other the portions defined by each frame connected in succession between two adjacent bearings. One thus obtains two twists by frames, or generally four twists with two frames, and, ultimately, the speed of production of the cable is multiplied with respect to the double twist machines by the number of frames.

However, the multiple twist machines described in the above patents comprise reverser means constituted by gear trains with planetary couples swivelling in side plates of the leading frame, with the exception of French Pat. No. 1,405,341 where the reverser means comprises an electric motor with an inductor integral with the adjacent frame and capable of turning at a speed double that of the exterior frame and in an opposite direction. The mechanical reverser machines comprise planetary couples swivelling in side plates of the frame necessitate strong frame structures, with equilibration of a disequilibrium due to the eccentric planetary couples. These frames are very heavy and load the bearings which, by virtue of the nesting of the frames, are imbalanced and difficult to align. The electric reverser according to French Pat. No. 1,405,341 is itself heavy, and increases the imbalance of the bearings of the central frame. As a practical matter the speed of rotation of the frames of known multiple twist or multiple twisting machines have been limited, such that the improvements in speed of production of the cable have been illusory, taking into account the necessary mechanical complications, and finally these machines have not resulted in anything but experimental exploitation. Furthermore the above patents are all prior to 1964, the oldest dating back to 1924, which clearly illustrates that they did not provide a practical solution to the problem posed by the increase of speed of cable production.

SUMMARY OF THE INVENTION

The invention has as an object a multiple twisting device, in particular quadruple, where the rotating masses are reduced so as to realize an increase in speed of cable production approaching the theoretical increase, the speed of rotation of the frames being on the same order as that of double twisting machines.

To this end, the invention proposes a multiple twisting machine with a multiplicity of nested frames, characterized in that the reverser means between two consecutive frames comprises two pinions in reciprocal drive swivelling in the same cage mounted directly and eccentrically on the axis with a stabilizing imbalance, each pinion being coupled to a frame by means of a belt passing on two pullies respectively integral with the pinion and the frame.

The reverser means thus constituted does not participate in the rotation of either of the frames, the imbalance of the eccentric cage maintaining it immobile with respect to rotation, such that only the pullies integral with the frames, balanced by construction, participate in the rotation. The speeds of rotation of the inverse driving and driven frames, are substantially of the same order of magnitude, being driven with respect to one element, the cage, substantially fixed in space. Finally, the structure of the frames, apart from the nesting of the intermediate barriers, are identical to that of a frame of a double twisting device, and as a result the speeds of rotation which are possible are substantially the same.

When the external frame is driven by a single end side plate, it is necessary to provide a brace for the two side plates, parallel to the shaft capable of withstanding the driving forces, in particular during start up. Also it is preferred to drive the external frame by each of the end cheek plates in synchronous rotation by means of a coupling means. The bracing of the two side plates no longer has a reinforcing function and can be very light, which equally reduces the moment of rotation of the external frame.

However, so that the frame remains capable of turning at high speed, it is very important not to borrow from the state of the technique an arrangement according to which the two side plates of the external frame, driven separately and synchronously are independent such that the cable passes freely from one side plate to the other because, according to this arrangement, if the frame does not comprise heavy braces, the cable, which cannot be held with a force greater than the unwinding resistance of the feed bobbins, assumes the form of a small chain between the side plates, with a sag increasing with the centrifugal force, which seriously limits the acceptable speed of rotation, as well as causing the equilibrium of the cable in the small chain to be unstable, in this sense means that an increase in the sag increases the centrifugal force, such that instanteously exceeding the traction resistance of the cable results in an increase of the sag which continues without resistance until the cable, caught up in one fixed portion of the machine or adjacent thereto kinks or breaks. It is thus necessary to maintain between the side plates a brace which forms a cable guide.

Yet, according to a preferred embodiment of the invention, the guiding of the cable in the eccentric fraction parallel to the axis between the side plates is assured by a rope held between these side plates and provided with eyelets where the cable passes. One thus assures a sufficient guidance of the cable to avoid having the cable escape under the effect of the centrifugal force, without substantially increasing the rotational moment of the side plates, such as is the case with tubular guide braces. Furthermore, the cable, when stretched, is easily adjusted in length without requiring precise adjustments necessary for the alignment of the bearings.

According to a preferred embodiment of the invention for a two frame quadruple twist machine, the internal frame is driven by its two end side plates across reverser means stablized by an imbalance, and comprises a cable guide rope between its two side plates. Even though the central frame of dimensions smaller than the external frame is less drawn by centrifugal force, it remains advantageous to reduce its rotational moment and to relieve as much the intermediate bearings between frames.

Figure 2:
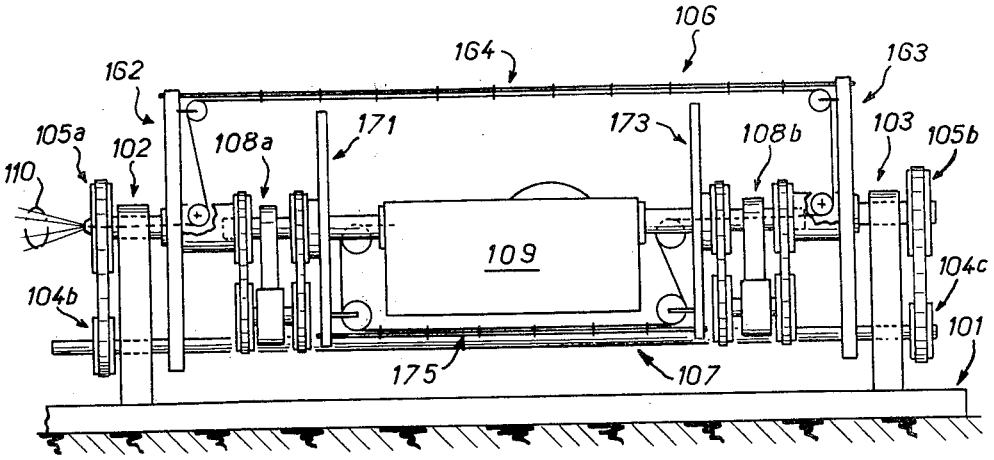
Figure 3:
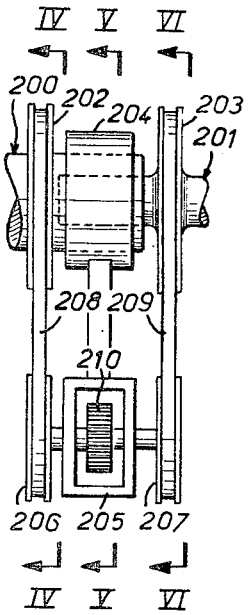
Figure 4:
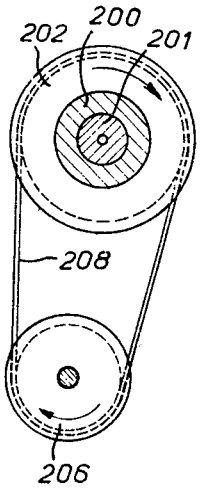
Figure 5:
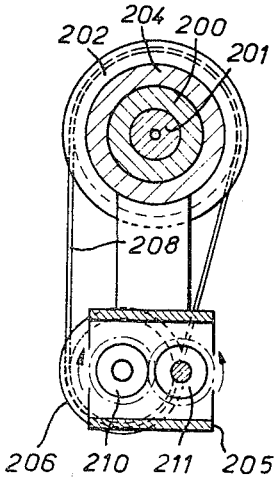
Figure 6:
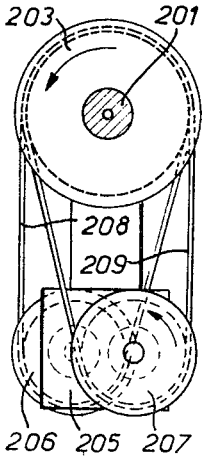

The characteristics and advantages of the invention will become clear from the description which will follow, by way of example, with reference to the annexed drawings in which:

FIG. 1 schematically represents in plan view a machine having four twists according to the invention;

FIG. 2 schematically represents in plan view an alternative machine having four twists;

FIG. 3 is a lateral perspective view of a rotation reverser;

FIGS. 4, 5, and 6 are cross sectional views along the respective planes IV—IV, V—V and VI—VI of FIG. 3.

According to an embodiment chosen and illustrated in FIG. 1, the quadruple twist machine comprises, on a base 1 resting on the ground, two bearing supports 2 and 3. A motor 4 drives a shaft 4*a* carrying two pullies 4*b* and 4*c* contiguous with the supports 2 and 3 towards the exterior. The pullies 4*b* and 4*c* drive, by means of a grooved belt the master pullies 5*a* and 5*b* respectively, turning in the bearings of the supports 2 and 3. These pullies 5*a* and 5*b* respectively drive two circular side plates 62 and 63 connected by a rope 64 to form an external frame 6.

An internal frame 7 in its entirety is mounted coaxially to the frame 6, turning in the bearings held by the side plates 62 and 63. The frame 7 comprises two side plates 71 and 73 connected by a bracing tube 75. A rotation reverser 8 is rotatably mounted relative to the shaft of the frame 7 between the side plates 62 and 71 and comprises a cage 80 containing two driven pinions having axes parallel to the axis of the frames. The pinions are integral with the pullies connected by notched belts to two pullies respectively integral with the side plates 62 of the frame 6 and 71 of the frame 7, such that the rotation of the side plate 62 is in a direction opposite to that of the frame 7. The reverser 8 will be described in detail below, with reference to FIGS. 3–6.

A cradle 9, rotatably mounted on bearings held by the frame 7, with a center of gravity below the axis, comprises a driving means 90 comprising a pulley wedged on the shaft, integral with the side plates 71 which support the cradle, and return assemblies towards a longitudinal shaft 93 which drives, on the one hand, a drawing winch 91, and on the other hand, a windup bobbin 92, by means of friction which assures the tension of a cable passing on the winch 91, such that the drawing speed is determined by the winch, regardless of the winding diameter of the cable on the bobbin 92. The pulling cradle is conventional.

To twist a cable, a set of feed bobbins mounted on the exterior furnishes unitary strands 10 which penetrate into the axis of rotation of the frames 6 and 7 via the bearing of side plate 62. A guide pulley at the center of the side plate 62, assures a radial return 11 of the cable in formation, which receives a first twist on this pulley. Another return pulley, substantially tangent to the rope 64, assures movement of return 12 parallel to the axis, the length of the rope 64 carrying eyelets in the portion of cable path 12 passes. At the end of the rope 64 attached to the side plate 63, the cable is radially returned at 13 towards the shaft, to axially traverse at 14 the side plates 63 and 73 belonging to the frames 6 and 7 which are rotating oppositely. The cable at 14 receives a double twist, which is added to the first twist at the inlet of the machine. In the frame 7, the cable is spaced radially at 15, follows the brace 75 in its portion of path 16 parallel to the shaft, returns radially at 17 and passes axially at 18 in the cradle 9, while receiving a fourth twist. It is noted that the twists result at the junction of an axial segment and a rotating radial segment, and that the direction of twisting is defined by the direction of rotation of the radial segment with respect to a point on the axial segment. Thus the four twists at the junctions 10–11, 13–14, 14–15, and 17–18, taking into account the reverse rotation of the frames 6 and 7, are all in the same direction and thus additive.

It will be noted that the frame 6 comprises only the rope 64 and the return pullies as asymmetric elements with respect to the axis of rotation, which are light elements. The rope 64 made of steel cable has as its only role to maintain the cable, in its portion of path 12, substantially parallel to the axis, by means of guiding eyelets, but does not act to link the two side plates 62 and 63 in rotation, which are synchronously driven by pullies 5*a* and 5*b*, respectively. The rotation reverser 8 is maintained substantially immobile by its own imbalance. As a result the external frame can withstand elevated rotational speeds without disequilibrium reactions on the bearings, while the cable is maintained substantially without sag in its portion 12. One can attain speeds of rotation of the frames of approximately 1200 rpm, comparable to those of double twist machines, and thus double the speed of production of the cable with respect to these double twist machines.

The machine shown in FIG. 2 comprises a base 101 having two roller bearing supports 102 and 103 analogous to that of the machine of FIG. 1. The external frame 106, with its side plates 162 and 163 and its rope 164, is equally analogous to that shown in FIG. 1, as are the drives of the frame 104*b*, 105*a* and 104*c*, 105*b*.

The central frame 107 has its side plates 171 and 173 respectively driven by reversers 108*a* and 108*b*, arranged like the reverser 8 of FIG. 1. The side plates 171 and 173 are connected by a taut rope 175 with guiding eyelets through which the cable passes, such that the central frame 107 has the same structure as the external frame 106, and the same advantages of lightness and capacity to withstand an elevated speed of rotation.

Of course, the cable follows the same path, from the unitary strands 110 until the pulling and winding cradle 109.

The rotation reverser shown in FIGS. 3–6 comprises, at the nesting of the bearings 200 and 201 respectively external and central frames, a cap 204 pivoting independently around the bearing or hub 200 of the exterior frame. Under the cap 204 is suspended a cage 205 in which are arranged two driven pinions 210 and 211. On the axis of the pinion 210 is wedged, exterior to the cage, a pulley 206, facing a pulley 202 wedged on the bearing 200 of the external frame. A notched belt 208 couples the pullies 202 and 206, which comprise teeth complementary with the notches in the belt 208; this conventional notched belt arrangement assuring coupling of the pulleys without sliding.

In an analogous fashion, on the axis of the pinion 211 is wedged a pulley 207, facing a pulley 203 wedged on the bearing 201 of the central frame. A notched belt 209 couples the pullies 207 and 203. When the external frame is in rotation the pulley 202 causes the rotation of the pinion 210, the cage 205, by virtue of its weight forming an imbalance, remaining substantially at the aplomb and beneath the capping 204. The cage has a generally stable position due to its weight. The pinion 210 drives the pinion 211 in reverse rotation, this rotation being transmitted by the pulley 207 to the pulley 203, and thus to the bearing 201 of the central frame. In fact, by virtue of the rotational resistances, the cage 205 hangs slightly obliquely beneath the cap 204, the moment due to the obliqueness of the arm connecting the cage 205 to the cap 204 with respect to the direction of gravity compensating for the resisting moments due to the rotation of the central frame.

It will be understood that in arranging a third frame between the frame 7 and the cradle 9 of FIG. 1, or between the frame 27 and the cradle 109 of FIG. 2, it will be in relation to the frame 7 (27) as frame 7 (27) is in relation to the frame 6 (26); one would thereby obtain a six-fold twisting, and so on by multiplying the number of frames. The number of twists is limited only by technological difficulties of providing of bearings between successive frames, which must each support one another, and from the restriction of the available space for the cradle in conjunction with the space taken up by the external frame.

Of course the invention is not limited to the examples described, but embraces all embodiments.

We claim:

1. A multiple twisting machine adapted to helically twist a plurality of unitary strands which are fed from feed bobbins along a predetermined path and to deliver a twisted cable to a windup bobbin, said machine comprising said bobbin and means for feeding said cable to said windup bobbin, at least two nested coaxial frames, said frames including a first central frame and a second external frame, a motor and means for reversing rotation, rotatably driving said frames in opposite directions and at substantially the same speed, each of said frames comprising at least two bearings and defining between said at least two bearings an eccentric portion of said cable path comprising a surface of revolution which encloses an internal space and which extends from a first end of said space to a second end outside of said space, said path passing axially within each of said at least two bearings whereby said cable receives two twists in the same direction when it passes through said at least two bearings of each of said frames, a shaft held within said first frame, a cradle rotatably mounted on said shaft, said cradle being held immobile and defining an end of said cable path, said path further comprising portions of each of said frames which extend between adjacent bearings on each of said frames, a cage, said means for reversing rotation comprising two rotatably and reciprocally driven pinions within said cage, said cage being pivotably and eccentrically mounted on an axis and generally having a stable position due to its weight, each of said pinions being coupled to one of said frames by a belt moving about two pulleys which are integral with said pinions.

2. A machine in accordance with claim 1 wherein said external frame comprises two external side plates driven synchronously by said motor and a coupling means.

3. A machine in accordance with claim 2 wherein said two side plates are connected by a rope comprising eyelets adapted to receive said cable along a portion of said path.

4. A machine in accordance with claim 3 adapted to helically twist said strands in quadruple fashion, said central frame comprising two side plates, each of said central frame side plates being driven by said means for reversing rotation, said rotation reversing means being positioned between one side plate of said first frame and one side plate of said second frame, said central frame side plates being connected by a taut rope having eyelets through which said cable passes and defining a section which is substantially parallel and eccentric to said portion of said cable path along said external frame.

5. A machine in accordance with claim 4, further comprising a second rotation reversing means positioned between the other side plate of said first frame and the other side plate of said second frame.

6. A machine in accordance with claim 1 wherein each of said belts are coupling notched belts and said pulleys have teeth which are complementary to said notches.

7. A machine in accordance with claim 1 wherein said pinions have axes parallel to axes of said frames.

8. A machine in accordance with claim 1 wherein said means for feeding comprises a winch.

* * * * *

UNITED STATES PATENT AND TRADEMARK OFFICE

CERTIFICATE OF CORRECTION

PATENT NO. : 4,328,662

DATED : May 11, 1982

INVENTOR(S) : Pierre BRETEGNIER et al.

It is certified that error appears in the above-identified patent and that said Letters Patent is hereby corrected as shown below: On the title page Abstract, line 15, "at" should be --of--.

Column 6, line 21, delete "of" (second occurrence).

Signed and Sealed this

*Third* Day of *August 1982*

[SEAL]

*Attest:*

GERALD J. MOSSINGHOFF

*Attesting Officer*

*Commissioner of Patents and Trademarks*